US007726892B2

(12) United States Patent
Lysiak et al.

(10) Patent No.: US 7,726,892 B2
(45) Date of Patent: Jun. 1, 2010

(54) DONOR CARTRIDGE FOR THERMAL PRINTER

(75) Inventors: Paul A. Lysiak, Rochester, NY (US); Kevin H. Blakely, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 516 days.

(21) Appl. No.: 11/512,859

(22) Filed: Aug. 30, 2006

(65) Prior Publication Data

US 2008/0056797 A1 Mar. 6, 2008

(51) Int. Cl.
*B41J 33/00* (2006.01)

(52) U.S. Cl. ..... 400/234; 400/247

(58) Field of Classification Search ..... 400/234, 400/247

See application file for complete search history.

(56) References Cited

U.S. PATENT DOCUMENTS

| | | | | |
|---|---|---|---|---|
| 4,147,439 | A * | 4/1979 | Colecchi | 400/208 |
| 4,373,824 | A * | 2/1983 | Olsen | 400/234 |
| 4,408,913 | A * | 10/1983 | Frechette | 400/208 |
| 4,910,602 | A * | 3/1990 | Sakuragi | 358/296 |
| 4,978,240 | A | 12/1990 | Katsuno | |
| 5,007,749 | A * | 4/1991 | Falconieri et al. | 400/208 |
| 5,709,485 | A * | 1/1998 | Kohno | 400/208 |
| 6,504,564 | B1 | 1/2003 | Funaki et al. | |
| 6,522,349 | B1 | 2/2003 | Lee | |
| 7,151,555 | B2 * | 12/2006 | Kaida et al. | 347/214 |
| 7,381,001 | B2 * | 6/2008 | Maruyama et al. | 400/120.01 |
| 2005/0201806 | A1 * | 9/2005 | Yamamoto | 400/208 |

FOREIGN PATENT DOCUMENTS

| | | | |
|---|---|---|---|
| DE | 3742337 | A1 | 6/1989 |
| EP | 0 294 792 | B1 | 8/1991 |
| EP | 0 869 009 | A2 | 10/1998 |
| EP | 0 857 580 | B1 | 4/2003 |
| JP | 05-169778 | | 7/1993 |
| JP | 05-254229 | | 10/1993 |

* cited by examiner

*Primary Examiner*—Anthony H. Nguyen
(74) *Attorney, Agent, or Firm*—Roland R. Schindler, II; David A. Novais

(57) ABSTRACT

A cartridge is provided with a supply housing having at least one exterior surface defining a supply area adapted to receive a donor ribbon of predetermined width and a take-up housing having a main wall that defines a take-up area for receiving donor ribbon of predetermined width. A take-up projection on the take-up housing and the main wall jointly define a take-up window therebetween through which donor ribbon passes into the take-up area. The take-up projection includes at least one tensioning feature so as to pre-load the take-up projection such that the take-up projection is inhibited from warping toward towards the main wall.

10 Claims, 8 Drawing Sheets

DONOR CARTRIDGE FOR THERMAL PRINTER

CROSS-REFERENCE TO RELATED APPLICATION

Reference is made to commonly assigned, co-pending U.S. patent application Ser. No. 11/479,853, entitled UNIVERSAL DONOR CARTRIDGE filed Jul. 3, 2006 in the name of Lysiak et al.

FIELD OF THE INVENTION

The invention relates to improvements in donor cartridges for use in thermal printers.

BACKGROUND OF THE INVENTION

A thermal printer produces images on a receiver medium by transferring donor material from a donor ribbon to the receiver medium by selectively heating the donor ribbon while simultaneously pressuring the donor ribbon against the receiver medium. In this way, heated donor material transfers from the donor ribbon to the receiver medium to form an image while unheated donor material remains on the donor ribbon. Transfer may be by flow of melted donor material or by movement of sublimated donor material to the receiver medium. The donor ribbon and receiver medium are separated after transfer of the material to yield a receiver medium having a pattern of deposited donor material forming an image.

Donor ribbon is typically connected between a supply spool, which initially carries a supply of unused donor ribbon, and a take-up spool upon which used donor ribbon is wound. In operation, the take-up spool is rotated to draw donor ribbon from the supply spool and across the print head for use in printing. Often the donor spool and take-up spool are joined together by a structural framework to form a thermal donor cartridge. This structural framework positions the supply spool and the take-up spool in a preferred geometric relationship to facilitate proper loading and can also be used to provide surfaces that enclose or otherwise protect the donor ribbon from damage due to incidental contact and from damage due to exposure to contaminants. Such a thermal donor cartridge is disclosed in commonly assigned, co-pending U.S. patent application Ser. No. 11/479,853 filed Jul. 3, 2006 in the name of Lysiak et al.

The cartridge disclosed in the above-mentioned U.S. patent application provides a take-up window between a take-up projection and a main wall of a donor ribbon take-up housing. Because the take-up projection needs to be very thin to meet other design criteria, the take-up projection tends to warp. Sometimes, the direction of warp is towards the main wall of the donor ribbon take-up housing; closing down the take-up window. When this occurs, it creates a donor pinch point during printing. Any such pinch point on the take-up side of the cartridge would cause an unusual gradient in the web tension on the take-up side of the thermal head, tending to result in image artifacts and resulting in user dissatisfaction.

Another potential problem associated with cartridges such as shown in the above-mentioned U.S. patent application pertains to the desire to produce a printer that does not cause unnecessary vibrations. Such vibrations can arise when a receiver material rubs across a lower portion of the take-up projection. The image receiver rubbing on the take-up projection during printing generates a particular vibration due to the flexibility of the guide rib. Such vibration would be considered to be objectionable to many users, and can impact printer performance.

SUMMARY OF THE INVENTION

In one aspect, a cartridge is provided with a supply housing having at least one exterior surface defining a supply area adapted to receive a donor ribbon of predetermined width and a take-up housing having a main wall that defines a take-up area for receiving donor ribbon of predetermined width. A take-up projection on the take-up housing and the main wall jointly define a take-up window therebetween through which donor ribbon passes into the take-up area. The take-up projection includes at least one tensioning feature so as to pre-load the take-up projection such that the take-up projection is inhibited from warping towards the main wall.

In another aspect, a cartridge is provided with a supply housing adapted to receive a donor ribbon of predetermined width and a take-up housing defining a take-up area. A connecting portion extends between the supply housing and the take-up housing to provide a printing path for the donor ribbon from the supply housing to the take-up area. A main wall and a take-up projection extend between the take-up housing and the connecting portion to define a take-up window therebetween through which the donor ribbon passes into the take-up area. The take-up projection includes at least one tensioning feature so as to pre-load the take-up projection to inhibit the take-up projection from warping toward towards the main wall.

In one embodiment the tensioning feature is adapted to force the take-up projection into a preloaded position, partially in tension and partially in compression, such as to dampen vibration of the take-up projection. The take-up projection has two ends and extends in a direction transverse to the path, the take-up projection being longer than the width of received donor ribbon. The tensioning feature is positioned on the take-up projection between the lateral edges of received donor ribbon and the end of the take-up projection.

DETAILED DESCRIPTION OF THE INVENTION

Figure 1:
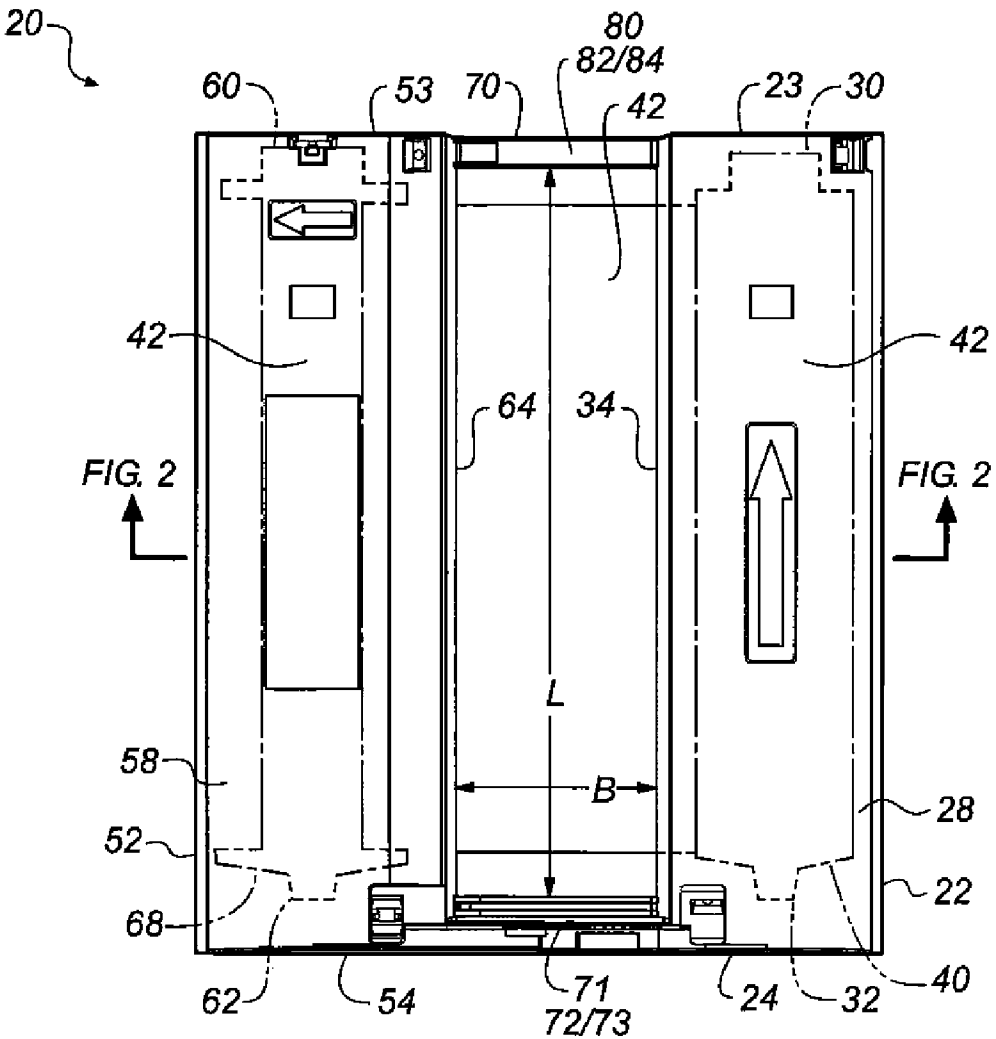
FIG. 1 is a top view of one embodiment of a donor cartridge.
Figure 2:
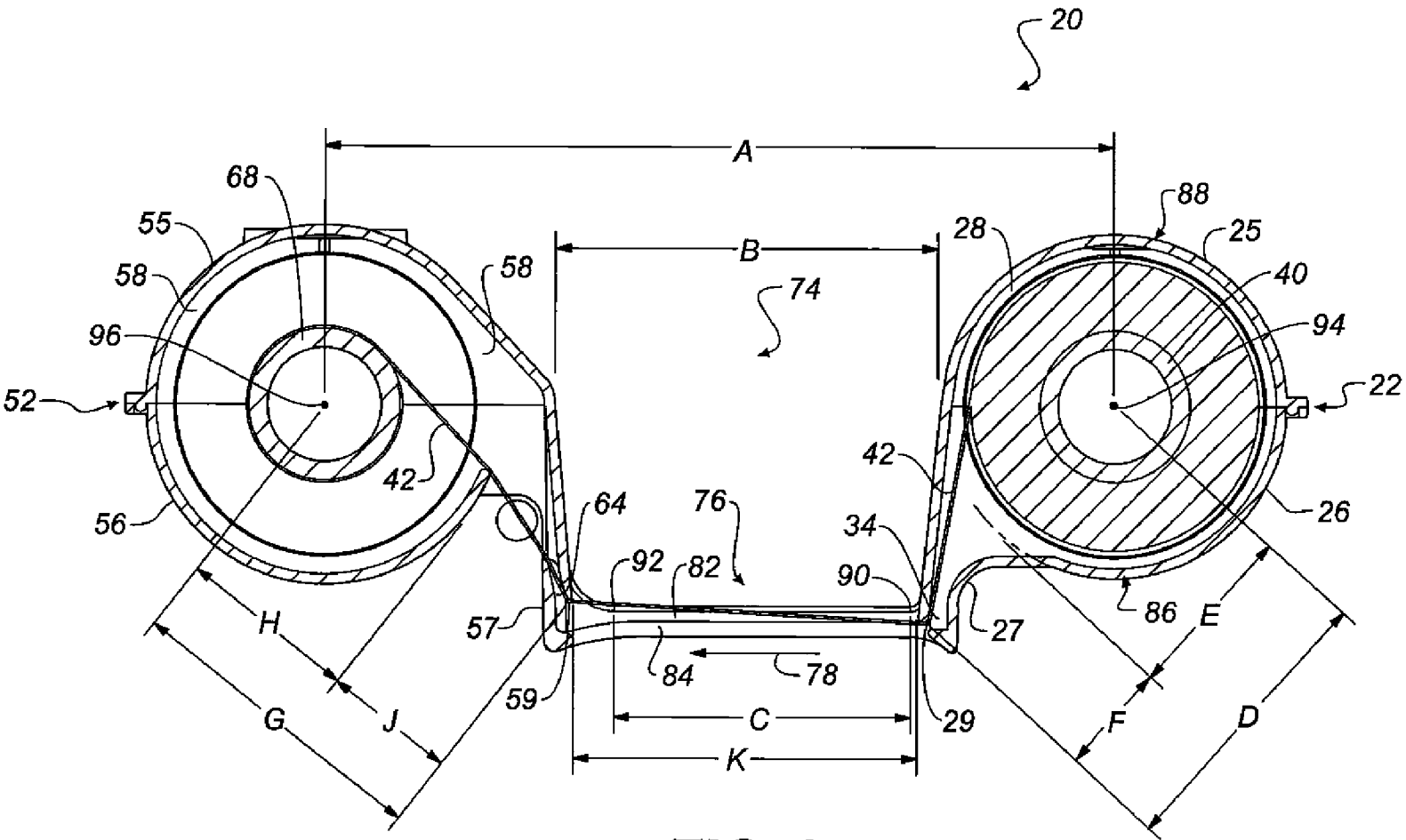
FIG. 2 is a side section view of the cartridge of FIG. 1.
Figure 3:
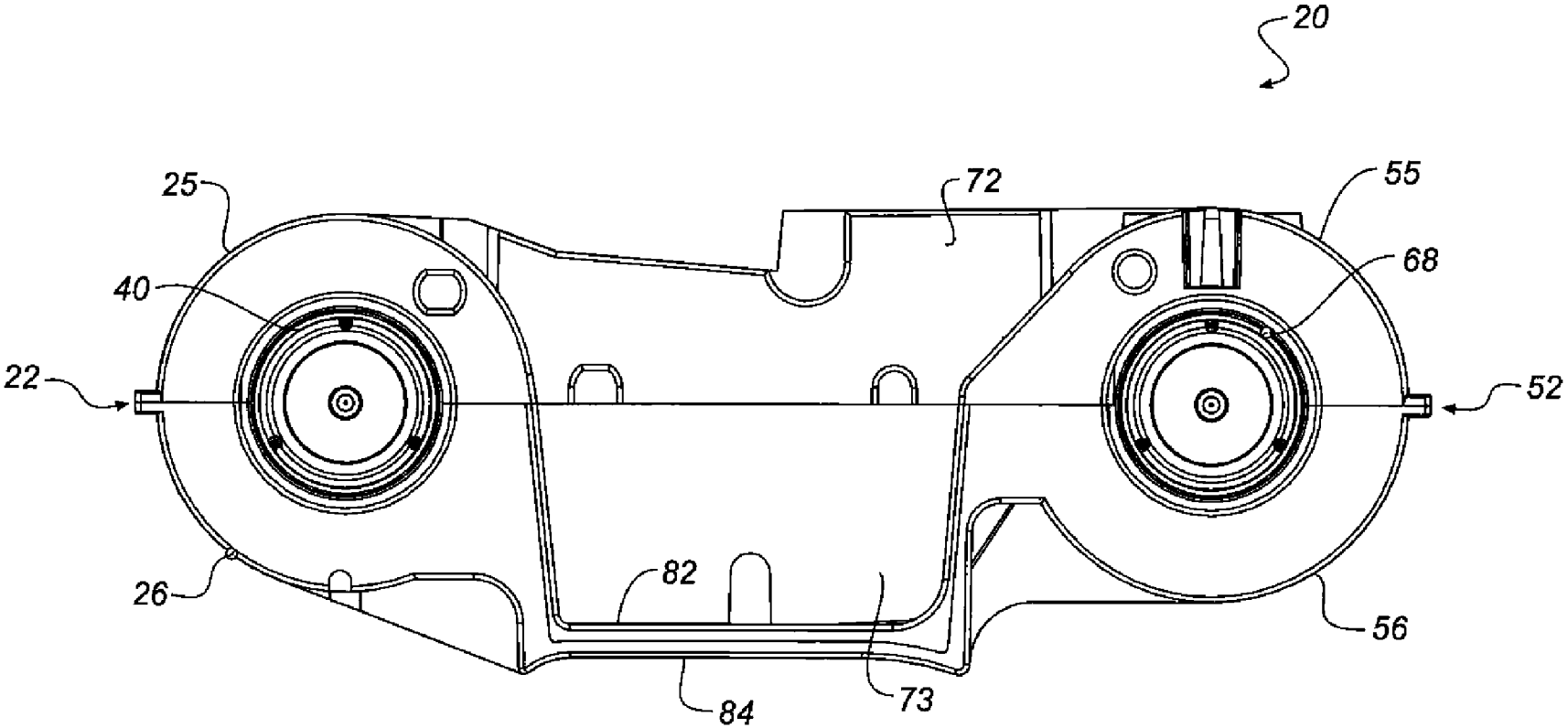
FIG. 3 is a drive end side view of the cartridge of FIG. 1.
Figure 4:
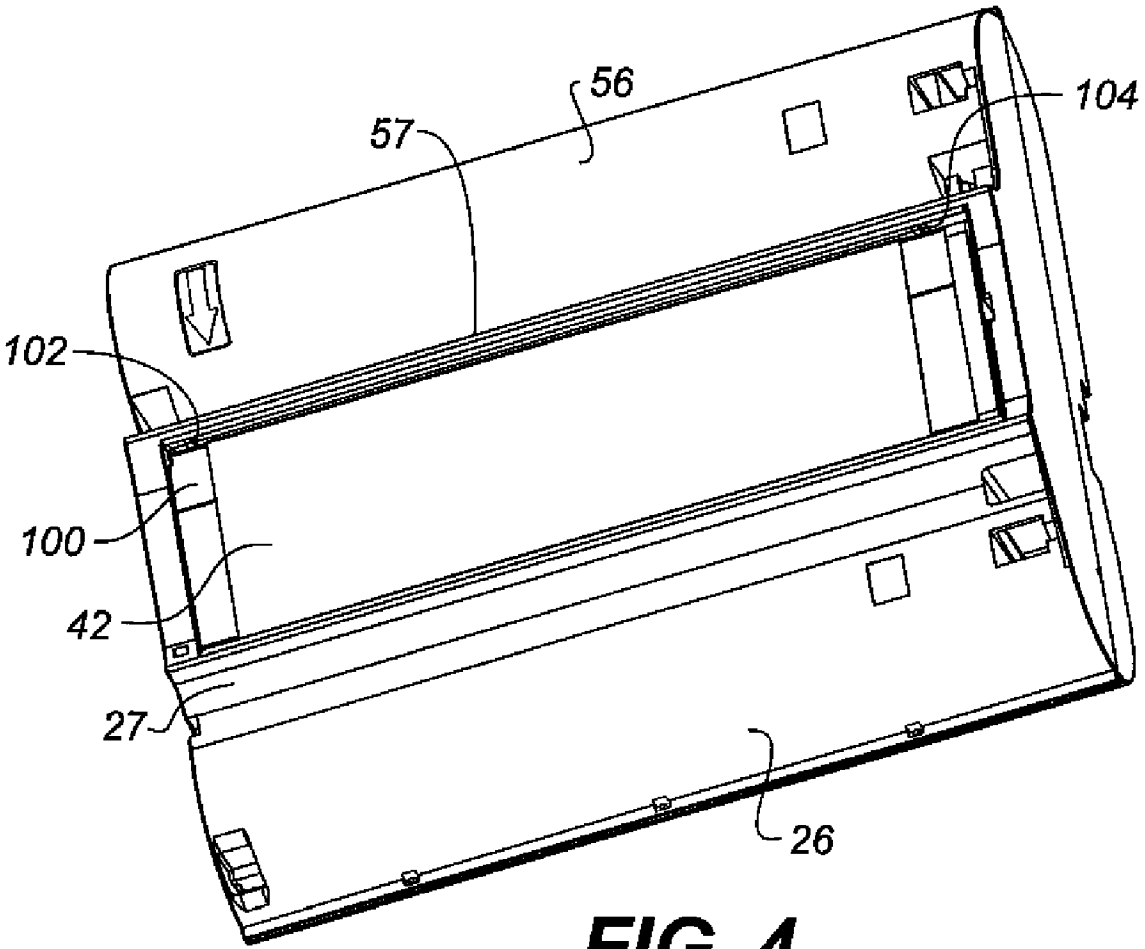
FIG. 4 is a bottom perspective view of the cartridge of FIG. 1.

FIGS. 1, 2 and 3 illustrate respectively a top, section and drive end side view of a thermal donor cartridge 20. The thermal donor cartridge 20 has a supply housing 22 with a drive end 23 and a non-drive end 24. Supply housing 22 is formed from an upper exterior surface 25 and a lower exterior surface 26 that define a supply area 28. Bearing surfaces 30 and 32 are provided by supply housing 22 and are adapted to receive and position a supply spool 40 having a supply of donor ribbon 42 within supply area 28. Donor ribbon 42 typically comprises a plurality of patches of different donor material arranged thereon in sets. Such donor materials can include dyes, colorants, inks or any other thermally transferable image forming materials as well as overcoat materials such as generally transparent protective overcoat materials.

A supply projection 27 is connected to lower exterior surface 26 and extends away from lower exterior surface 26 to allow donor ribbon 42 to pass from supply area 28 to a supply waypoint 29. As is illustrated in FIG. 1, supply-housing 22 provides a supply window 34 through which donor ribbon 42 passes from supply projection 27.

Thermal donor cartridge 20 also has a take-up housing 52 with a drive end 53 and a non-drive end 54. Take-up housing 52 is shown having an upper exterior surface 55 and a lower exterior surface 56 that define a take-up area 58. Bearing surfaces 60 and 62 are provided by take-up housing 52 and are adapted to receive a take-up spool 68 that is connected to donor ribbon 42.

A take-up projection 57 extends away from lower exterior surface 56 to allow donor ribbon 42 to pass from a take-up waypoint 59 to take-up area 58. As is illustrated in FIGS. 1 and 2, take-up housing 52 provides a take-up window 64 through which donor ribbon 42 can be received from take-up projection 57 so that donor ribbon 42 can pass from take-up waypoint 59 into take-up area 58 and onto take-up spool 68.

Supply housing 22 and take-up housing 52 are joined to and are held apart by a connecting portion 70 to form a separation area 74 therebetween along a length of thermal donor cartridge 20. Connecting portion 70 comprises a non-drive end linkage 71 linking non-drive end 24 of supply housing 22 to non-drive end 54 of take-up housing 52, and a drive end linkage 80 linking drive end 23 of supply housing 22 to drive end 53 of take-up housing 52. Non-drive end linkage 71 and drive end linkage 80 extend for a distance to define a lateral separation between supply housing 22 and take-up housing 52.

Access window 76 allows printing structures to contact donor ribbon 42 so that at least a portion of donor ribbon 42 positioned along printing path 78 can be used for printing without substantially removing donor ribbon 42 from thermal donor cartridge 20. In practice this typically means that a thermal printhead (not shown) can be advanced against a top surface of donor ribbon 42 to drive donor ribbon 42 against a receiver medium (not shown) that is supported by a platen or such like supporting printing surface (not shown).

Supply waypoint 29 takes the form of a surface, which can be a stationary surface such as an edge of supply main wall projection 101, a bar (not shown) or a rotating surface such as a shaft (not shown) around which donor ribbon 42 turns to enter a printing path 78. Printing path 78 extends from supply waypoint 29, through access window 76 to take-up waypoint 59. Donor ribbon 42 turns at take-up waypoint 59 for travel through take-up window 64 to take-up area 58. Take-up waypoint 59 can be a stationary surface such as an edge of take-up projection 57, a bar (not shown) or a rotating surface such as a shaft (not shown) around which donor ribbon 42 passes while exiting printing path 78.

In this way, thermal donor cartridge 20 provides a donor ribbon path that flows from supply housing 22, along supply projection 27, to supply waypoint 29 through access window 76 and along a printing path 78 to take-up waypoint 59, along take-up projection 57 and into take-up housing 52. Any of these structures can provide surfaces that contact donor ribbon 42 and that can be used as donor ribbon guides leading the donor ribbon 42 from supply housing 22 through supply side edge 90 of access window 76 to a take-up side edge 92 of access window 76 and to take-up housing 52. Accordingly, such donor ribbon guides can comprise the donor path.

Thermal donor cartridge 20 is formed by inserting supply spool 40 and take-up spool 68 into one of a lower housing 86 or an upper housing 88 and assembling the other of the lower housing 86 or upper housing 88 thereto. In the embodiment illustrated, non-drive end linkage 71 comprises an non-drive end linkage upper portion 72 provided by upper housing 88 and a non-drive end linkage lower portion 73 provided by lower housing 86, while drive end linkage 80 comprises a drive end linkage upper portion 82 on upper housing and a drive end linkage lower portion 84 on lower housing 86.

It will be appreciated that in other embodiments of the present invention, supply-housing 22, take-up housing 52, and connecting portion 70 can be formed using more or different components and using different assembly techniques.

FIG. 2 further illustrates geometric relationships between various dimensions of cartridge of FIGS. 1, 2, and 3, that will be used in the following discussions of the design the parameters for the thermal donor cartridge 20. FIG. 2 shows a cross section view of thermal donor cartridge 20 taken along the line illustrated in FIG. 1.

As can be seen in FIG. 2, thermal donor cartridge 20 has a spool separation distance A defined as a separation between a supply spool axis 94 defined by bearing surfaces 30 and 32 for supply spool 40 and a take-up spool axis 96 defined by bearing surfaces 60 and 62 for take-up spool 68. Within the spool separation distance A is separation area 74 between supply housing 22 and take-up housing 52. As noted above, separation area 74 extends along a horizontal length B between supply housing 22 and take-up housing 52.

Printing path 78 extends along a horizontal length K from supply waypoint 29 to take-up waypoint 59. Access window 76 extends along a horizontal length C of thermal donor cartridge 20 from a supply side edge 90 to a take-up side edge 92 of access window 76.

As is also shown in FIG. 2, the arrangement of supply housing 22, supply projection 27 and connecting portion 70 position supply waypoint 29 at a supply side waypoint offset D measured along a supply spool axis 94 to supply waypoint 29, while lower exterior surface 26 of supply housing 22 is positioned at a supply housing offset E measured along supply spool axis 94. As is shown in FIG. 2, supply side waypoint offset D is larger than supply housing offset E. This creates a supply side separation F. As will be discussed and illustrated in greater detail below, supply side separation F is intended to provide sufficient separation to allow a pinch roller to be positioned proximate to supply waypoint 29 so that thermal donor cartridge 20 can be used in thermal printers that utilize a dual pinch roller receiver system to move a receiver medium during printing.

Similarly, the arrangement of take-up housing 52, take-up projection 57, and connecting portion 70 position take-up waypoint 59 at a take-up side waypoint offset G measured along a take-up spool axis 96 from take-up waypoint 59 to take-up spool axis 96, while lower exterior surface 56 of take-up housing 52 is positioned at a take-up housing offset H measured along take-up spool axis 96. As is shown in FIG. 2, take-up side waypoint offset G is larger than take-up housing offset H. This creates a take-up side separation J. As will be discussed and illustrated in greater detail below, take-up side separation J is intended to provide sufficient separation to allow a pinch roller to be positioned proximate to take-up waypoint 59 so that thermal donor cartridge 20 can be used in thermal printers that utilize a dual pinch roller receiver system to move a receiver medium during printing.

Figure 5:
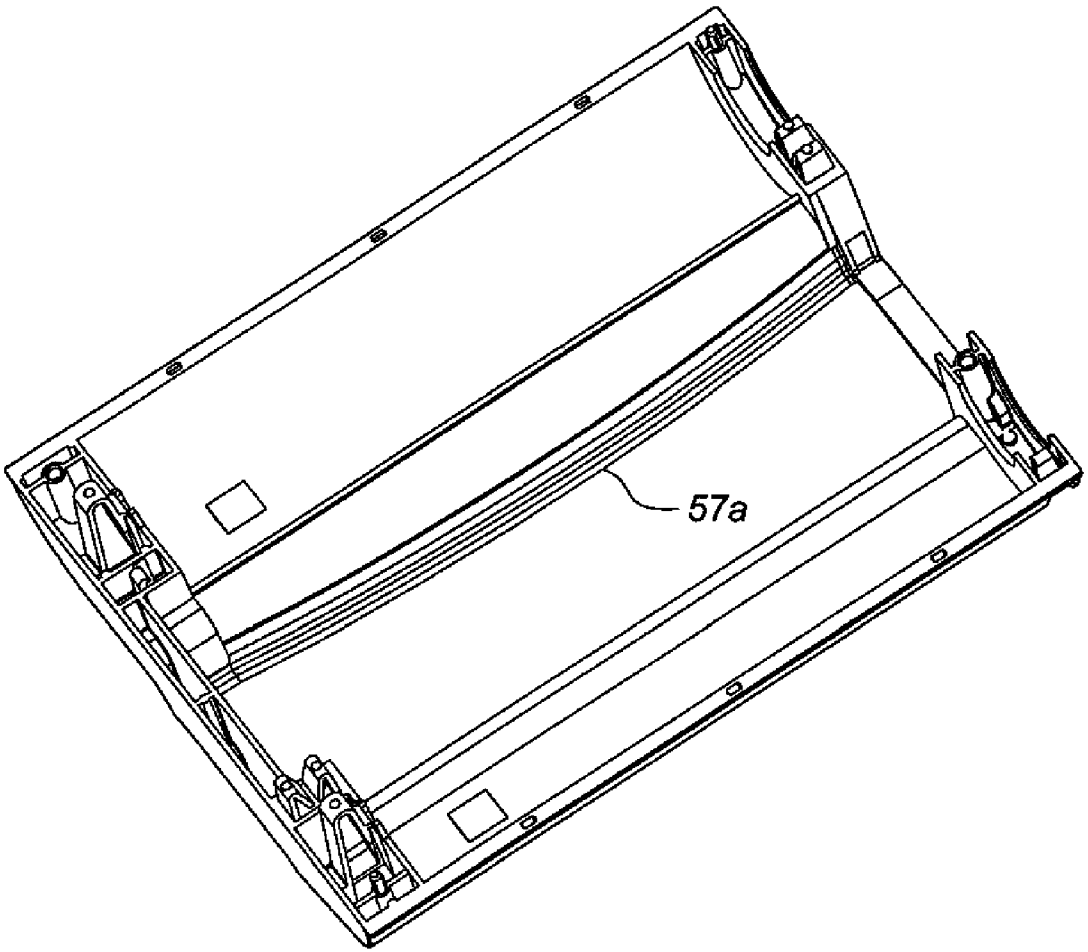
FIG. 5 is a top perspective view of a lower portion of a cartridge that does not include features of the present invention and that illustrates the problem overcome by the present invention.
Figure 7:
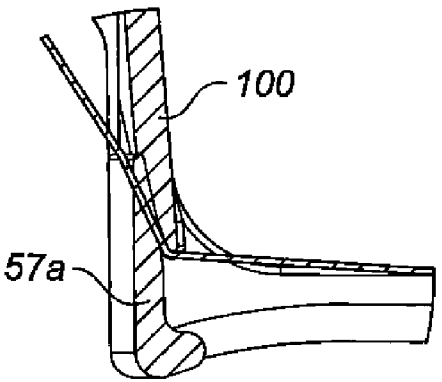
FIG. 7 is an enlarged detail view of a portion of the cartridge of FIG. 5.
Figure 6:
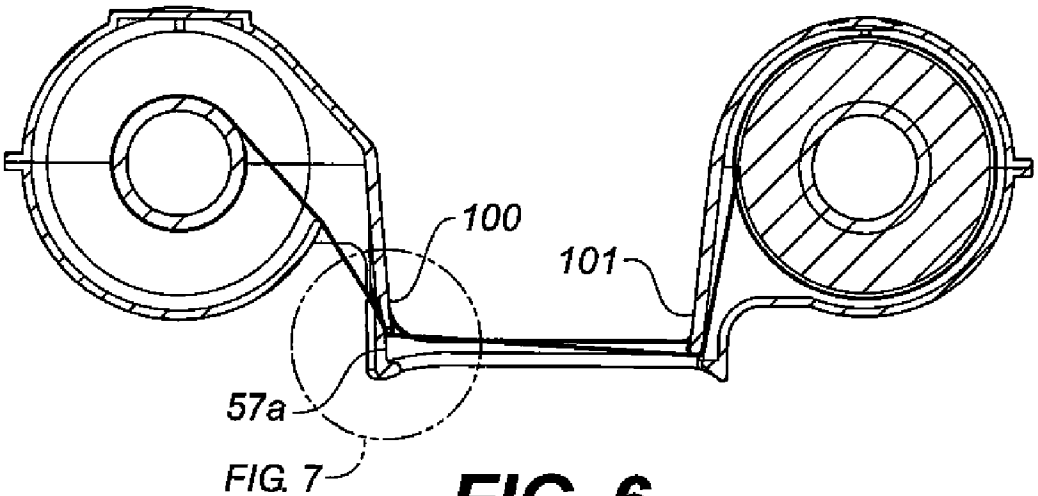
FIG. 6 is a side section view of the cartridge of FIG. 5.
Figure 10:
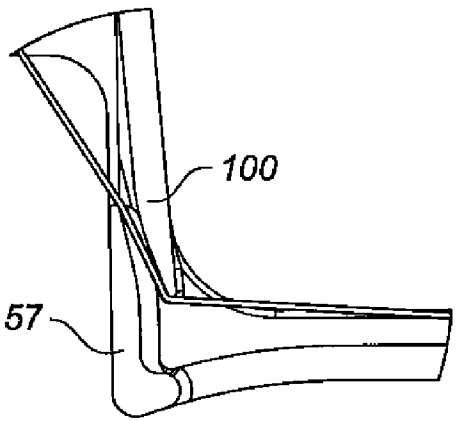
FIG. 10 is an enlarged detail view of a portion of the cartridge of FIG. 8.

As best seen in FIG. 10, take-up window 64 is defined between take-up projection 57 of the lower cartridge and a main wall 100 of the upper cartridge half. Referring for a moment to FIG. 5, which is included to illustrate a potential problem associated with cartridges similar to that of the present invention, a modified take-up projection 57*a* tends to warp due to its necessary thinness. Sometimes, modified take-up projection 57*a* tends to warp towards main wall 100 of the upper cartridge half. This is illustrated in FIGS. 5, 6 and 7. When this occurs, it creates a donor pinch point during printing. Any such pinch point on the take-up side of cartridge 20 would cause an unusual gradient in the web tension on the take-up side of the thermal head, tending to result in image artifacts and resulting in user dissatisfaction.

Another potential problem associated with cartridges such as shown in FIGS. 5, 6 and 7 pertains to the desire to produce a low vibration printer. As can be seen in FIG. 3, receiver material rubs across the lower portion of modified take-up projection 57*a*. The image receiver rubbing on the modified take-up projection 57*a* during printing generates a particular vibration due to the flexibility the portion of modified take up projection 57*a*. Such vibration could be considered to be objectionable and potentially create an objectionable acoustic noise.

Figure 8:
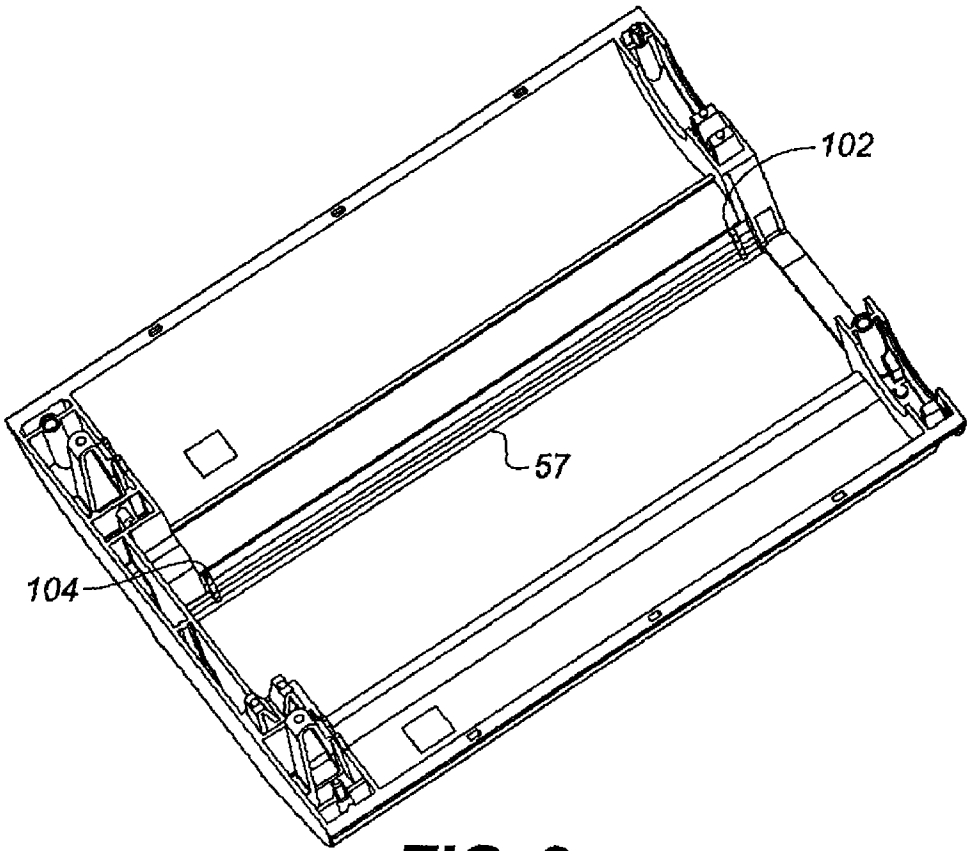
FIG. 8 is a top perspective view of a lower portion of the cartridge of FIG. 1.
Figure 9:
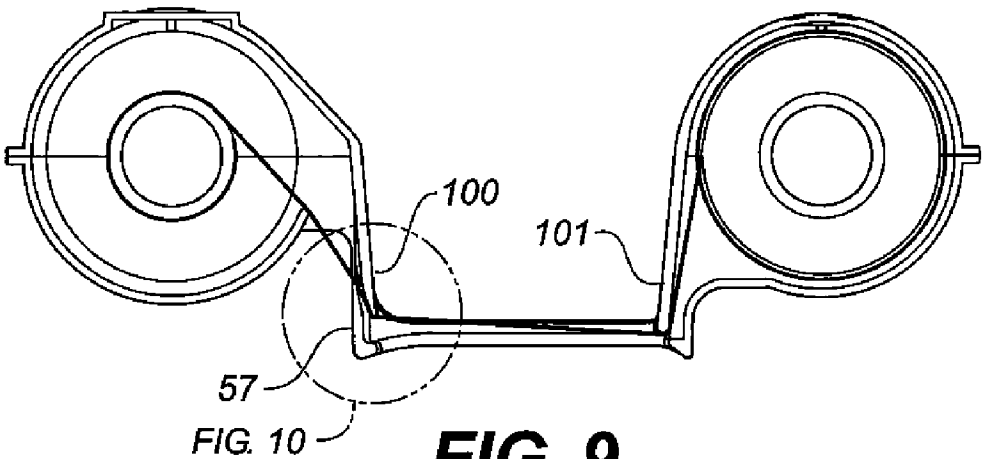
FIG. 9 is a side section view of the cartridge of FIG. 8.

In order to overcome the potential problems of "donor pinch" and unnecessary vibration, one or more tensioning features are provided that preload take-up projection 57. In one embodiment illustrated in FIG. 8, a pair of tensioning features 102 and 104 have been positioned towards the outermost ends of take-up projection 57 so as to be between the lateral edges of the donor and the ends of take-up projection 57. As can be seen in FIG. 8 and perhaps more clearly in FIGS. 9 and 10 (particularly when compared to FIGS. 5-7, respectively), the tensioning features pre-load take-up projection 57 so that it does not warp toward towards main wall 100 of the upper cartridge half, eliminating the risk of creating a donor pinch point during printing. The tensioning features also force take-up projection 57 into a preloaded position, partially in tension and partially in compression, which tends to dampen the sounds created by vibration of the take-up projection 57.

The invention has been described in detail with particular reference to certain preferred embodiments thereof, but it will be understood that variations and modifications can be effected within the spirit and scope of the invention.

PARTS LIST

20 cartridge
22 supply housing
23 drive end
24 non-drive end
25 upper exterior surface
26 lower exterior surface
27 supply projection
28 supply area
29 supply waypoint
30 bearing surface
32 bearing surface
34 supply window
40 supply spool
42 donor ribbon
52 take-up housing
53 drive end
54 non-drive end
55 upper exterior surface
56 lower exterior surface
57 take-up projection
57*a* modified take-up projection
58 take-up area
59 take-up waypoint
60 bearing surface
62 bearing surface
64 take-up window
68 take-up spool
70 connecting portion
71 non-drive end linkage
72 non-drive end linkage upper portion
73 non-drive end linkage lower portion
74 separation area
76 access window
78 printing path
80 drive end linkage
82 drive end linkage upper portion
84 drive end linkage lower portion
86 lower housing
88 upper housing
90 supply side edge of access window
92 take-up side edge of access window
94 supply spool axis
96 take-up spool axis
100 main wall
101 supply main wall
102 tensioning feature
104 tensioning feature
A spool separation distance
B separation area horizontal length
C horizontal length of access window
D supply side waypoint offset
E supply housing offset
F supply side separation
G take-up side waypoint offset
H take-up housing offset
J take-up side separation
K horizontal length between waypoints

The invention claimed is:

1. A cartridge comprising:

a supply housing having at least one exterior surface defining a supply area adapted to receive a donor ribbon of predetermined width;

a take-up housing having a main wall defining a take-up area for receiving donor ribbon of predetermined width; and a take-up projection on the take-up housing, said take-up projection and said main wall jointly defining a take-up window there between through which donor ribbon passes into the take-up area, the take-up projection including at least one tensioning feature so as to pre-load the take-up projection to inhibit the take-up projection from warping towards the main wall, said at least one tensioning feature being located at one end of the take-up projection.

2. A cartridge as set forth in claim 1, wherein the at least one tensioning feature is adapted to force the take-up projection into a preloaded position, partially in tension and partially in compression, such as to dampen vibration of the take-up projection.

3. A cartridge comprising:

a supply housing having at least one exterior surface defining a supply area adapted to receive a donor ribbon of predetermined width;

a take-up housing having a main wall defining a take-up area for receiving donor ribbon of predetermined width; and a take-up projection on the take-up housing, said take-up projection and said main wall jointly defining a take-up window there between through which donor ribbon passes into the take-up area, the take-up projection including at least one tensioning feature so as to pre-load the take-up projection to inhibit the take-up projection from warping towards the main wall;

wherein:

the take-up projection has two ends and extends in a direction transverse to the path, the take-up projection being longer than the width of received donor ribbon; and the at least one tensioning feature is positioned on the take-up projection between the lateral edges of received donor ribbon and the end of the take-up projection.

4. A cartridge comprising:

a supply housing having at least one exterior surface defining a supply area adapted to receive a donor ribbon of predetermined width;

a take-up housing defining a take-up area;

a connecting portion between the supply housing and the take-up housing, said connecting portion providing a printing path for the donor ribbon from the supply area to the take-up area; and a main wall and a take-up projection extend between the take-up housing and the connecting portion to define a take-up window there between through which the donor ribbon passes from the connecting portion into the take-up area, the take-up projection including at least one tensioning feature so as to pre-load the take-up projection to inhibit the take-up projection from warping towards the main wall, said at least one tensioning feature being located at one end of the take-up projection.

5. A cartridge as set forth in claim 4, wherein the at least one tensioning feature is adapted to force the take-up projection into a preloaded position, partially in tension and partially in compression, such as to dampen vibration of the take-up projection.

6. A cartridge comprising:

a supply housing having at least one exterior surface defining a supply area adapted to receive a donor ribbon of predetermined width;

a take-up housing defining a take-up area;

a connecting portion between the supply housing and the take-up housing, said connecting portion providing a printing path for the donor ribbon from the supply area to the take-up area; and a main wall and a take-up projection extend between the take-up housing and the connecting portion to define a take-up window there between through which the donor ribbon passes from the connecting portion into the take-up area, the take-up projection including at least one tensioning feature so as to pre-load the take-up projection to inhibit the take-up projection from warping towards the main wall wherein:

the take-up projection has two ends and extends in a direction transverse to the path, the take-up projection being longer than the width of received donor ribbon; and the at least one tensioning feature is positioned on the take-up projection between the lateral edges of received donor ribbon and the end of the take-up projection.

7. A cartridge as set forth in claim 1, further comprising a second tensioning feature located at a second end of the take-up projection.

8. A cartridge as set forth in claim 3, further comprising a second tensioning feature on the take-up projection.

9. A cartridge as set forth in claim 4, further comprising a second tensioning feature located at a second end of the take-up projection.

10. A cartridge as set forth in claim 6, further comprising a second tensioning feature on the take-up projection.

* * * * *